US007422418B2

(12) United States Patent
Ishijima et al.

(10) Patent No.: US 7,422,418 B2
(45) Date of Patent: Sep. 9, 2008

(54) CROSS FLOW FAN

(75) Inventors: Mitsuyoshi Ishijima, Shizuoka-Ken (JP); Kaku Okada, Yamanashi-Ken (JP)

(73) Assignee: Toshiba Carrier Corporation, Tokyo (JP)

( * ) Notice: Subject to any disclaimer, the term of this patent is extended or adjusted under 35 U.S.C. 154(b) by 517 days.

(21) Appl. No.: 11/187,018

(22) Filed: Jul. 22, 2005

(65) Prior Publication Data

US 2006/0018750 A1 Jan. 26, 2006

(30) Foreign Application Priority Data

Jul. 27, 2004 (JP) ..... 2004-218925

(51) Int. Cl.
*F04D 5/00* (2006.01)

(52) U.S. Cl. ..... 416/178; 416/187; 416/198 R; 416/243; 416/DIG. 2; 416/DIG. 5; 415/53.1; 415/119

(58) Field of Classification Search ..... 415/53.1–53.3, 415/119; 416/178, 187, 186 R, 198 R, 200, 416/223 B, 243, DIG. 2, DIG. 5, 200 R
See application file for complete search history.

(56) References Cited

U.S. PATENT DOCUMENTS 3,140,042 A * 7/1964 Fujii ..... 416/243
5,944,481 A * 8/1999 Stone et al. ..... 415/53.1
6,261,051 B1 * 7/2001 Kolacny ..... 415/53.3
7,118,345 B2 * 10/2006 Wu et al. ..... 416/210 R
2003/0194311 A1 * 10/2003 Ahn et al. ..... 415/53.1

FOREIGN PATENT DOCUMENTS

JP 10-131886 5/1998

* cited by examiner

*Primary Examiner*—Christopher Verdier
(74) *Attorney, Agent, or Firm*—Finnegan, Henderson, Farabow, Garrett & Dunner, L.L.P.

(57) ABSTRACT

A cross flow fan of an indoor unit of, for example, an air conditioner includes a pair of disc-shaped end plates and a plurality of fan blades attached to the end plates in a ring-shaped arrangement. Each of the fan blades has a cross sectional area ratio of Sa/Sb in a range of 1.3 to 1.6, preferably, 1.4 to 1.5, in which Sa is a sectional area of a fan inner peripheral side half portion of the blade and Sb is a sectional area of a fan outer peripheral side half portion of the blade at a time when the fan blade is cut perpendicularly with respect to a longitudinal direction of the fan blade and divided into two sectional areas along a central division line in a blade chord direction.

5 Claims, 4 Drawing Sheets

CROSS FLOW FAN

BACKGROUND OF THE INVENTION

1. Field of The Invention

The present invention relates to a cross flow fan, preferably of an indoor unit of an air conditioner, provided with fan blades having an improved shape.

2. Related Art

An air conditioner has an indoor unit and an outdoor unit, and many of the indoor units are generally provided with cross flow fans.

Such cross flow fan in a prior art is provided with a plurality of fan blades each having a cross sectional shape shown in FIG. 10, for example. In the illustration of the sectional view, a fan blade 11 is divided into symmetrical two parts by a dividing vertically at its central portion with a division line L so as to provide the same arcuate chord length of the blade 11. Such sectional shapes of both the portions have outer and inner peripheral arc portions substantially parallel to each other and substantially the same thickness along the blade chord direction. A cross fan blade having such structure is, for example, disclosed in Japanese Patent Laid-open Publication No. HEI 10-131886.

However, in such structure of the cross fan blade, in a case where an air suctioning port of the cross flow fan becomes subject to a high load due to an influence of a heat exchanger and a suction filter, it tends to increase an air blasting noise and increase a load to be applied on a fan driving motor, thus deteriorating an operational performance of the air conditioner itself.

SUMMARY OF THE INVENTION

The present invention was therefore conceived in consideration of the above matters encountered in the prior art, and an object of the present invention is to provide a cross flow fan particularly of an indoor unit of an air conditioner capable of being operated at a low noise even in a high load operation, reducing a load to be applied to a fan driving motor and realizing a highly efficient performance of an air conditioner provided with such cross flow fan.

This and other objects can be achieved according to the present invention by providing, in one aspect, a cross flow fan comprising:

a pair of disc-shaped end plates; and a plurality of fan blades attached to the end plates in a ring-shaped arrangement, wherein each of the fan blades has a cross sectional area ratio of Sa/Sb in a range of 1.3 to 1.6, preferably, 1.4 to 1.5, in which Sa is a sectional area of a fan outer peripheral side half portion of the blade and Sb is a sectional area of a fan inner peripheral side half portion of the blade at a time when the fan blade is cut perpendicularly with respect to a longitudinal direction of the fan blade and divided into two sectional areas along a central division line in a blade chord direction.

In a second aspect of the present invention, there is provided a cross flow fan comprising:

a pair of disc-shaped end plates; and a plurality of fan blades attached to the end plates in a ring-shaped arrangement, wherein each of the fan blades has a dimensional ratio of Rb/Ra in a range of 0.1 to 0.8, in which Ra is a dimension of a fan inner peripheral side tip end R-portion of the blade and Rb is a dimension of a fan outer peripheral tip end R-portion of the blade at a time when the fan blade is cut perpendicularly with respect to a longitudinal direction of the fan blade and divided into two sectional areas along a central division line in a blade chord direction.

In a third aspect, there is also provided a cross flow fan comprising:

a pair of disc-shaped end plates; and a plurality of fan blades attached to the end plates in a ring-shaped arrangement, wherein each of the fan blades has a central portion in a blade chord direction at which the fan blade has a most thickened portion in section when the fan blade is cut perpendicularly with respect to a longitudinal direction of the fan blade and divided into two sectional areas by the central portion in the blade chord direction.

In the above aspect, the cross flow fan may be further provided with at least one disc shaped partition plate which is disposed between the end plates and to which the fan blades are attached in a ring shaped arrangement.

Furthermore, a cross flow fan having a combined structure of the above first to three aspects may be further preferably provided.

According to the cross flow fan of the present invention of the characters mentioned above, when incorporated into an indoor unit of, for example, an air conditioner, air flow noise can be effectively reduced and a load to be applied to a motor for driving the fan can be also reduced, thus providing a high operational efficiency of the air conditioner.

The nature and further characteristic features of the present invention will be made more clear from the following descriptions made with reference to the accompanying drawings.

DESCRIPTION OF THE PREFERRED EMBODIMENT

Preferred embodiments of the present invention of a cross flow fan assembled, for example, in an indoor unit of an air conditioner will be described hereunder with reference to the accompanying drawings.

Figure 1:
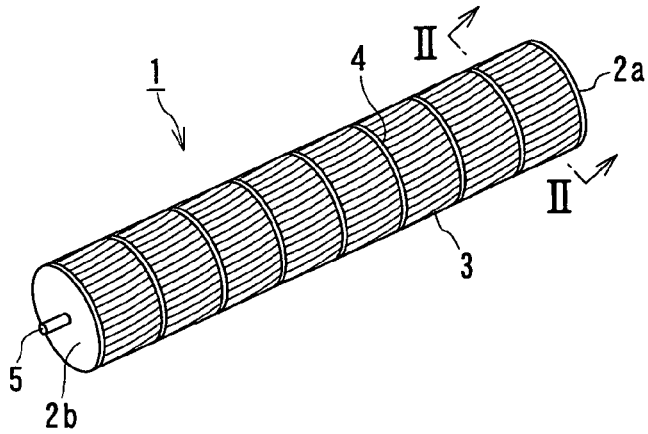
FIG. 1 is a perspective view of a cross flow fan to which the present invention is applied.
Figure 2:
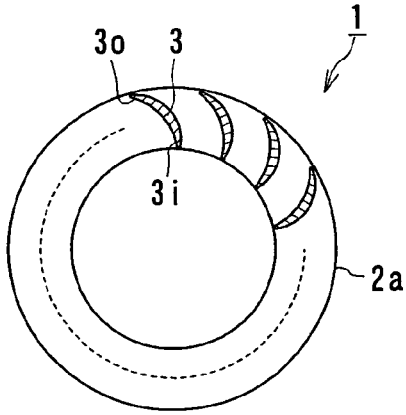
FIG. 2 is a cross sectional view of the cross flow fan of FIG. 1 taken along the line II-II, in which only few blades are shown.

With reference to FIGS. 1 and 2, a cross flow fan 1 according to the present invention is specifically applicable as an indoor fan accommodated in an indoor unit of an air conditioner. The cross flow fan 1 has a pair of end plates 2*a*, 2*b*, each having a disc-shape, to one (2*b*, in the illustration) of which a rotational shaft 5 is mounted. The shaft 5 is operatively connected to a fan driving device such as electric motor, not shown. The cross flow fan 1 is provided with a plurality of fan blades 3 disposed between the end plates 2*a*, 2*b* and attached thereto in a coaxial ring shape in a manner inclined at a predetermined angle, as shown in FIG. 2, each fan blade having a circular-arc cross section.

Between the end plates 2*a* and 2*b*, a plurality of, or at least one of, ring-shaped (disc-shaped) partition plates 4, seven in FIG. 1, may be arranged in the axial direction between the end plates 2*a*, 2*b* at a predetermined pitch. The fan blades 3 are attached to the partition plates 4 or end plates 2*a*, 2*b* at their one ends. When the rotational shaft 5 is rotated, the fan blades 3 are rotated to thereby feed air.

Figure 3:
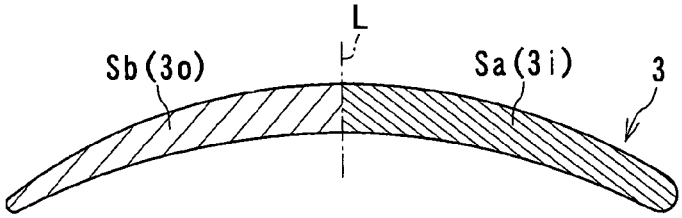
FIGS. 3, 4 and 5 are schematic sectional views, in an enlarged scale, of a blade of the cross flow fan according to the embodiment of the present invention.
Figure 4:
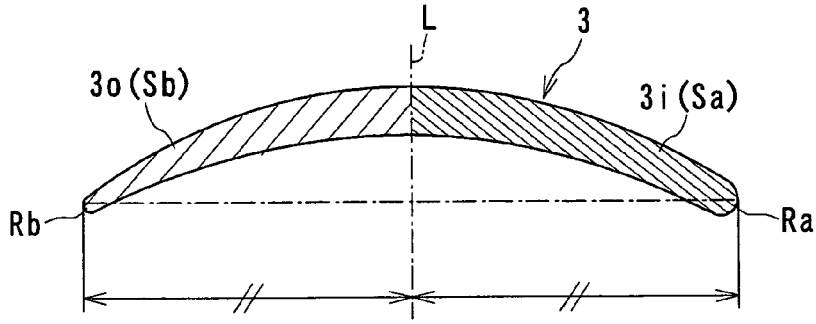
Figure 5:
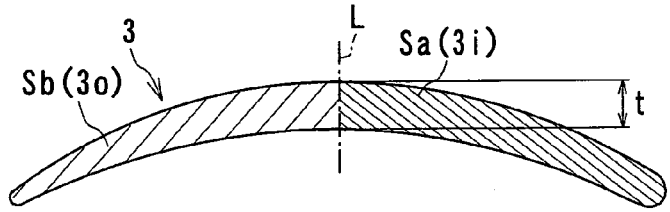

Next, FIGS. 3 to 5 show the fan blade 3 cut perpendicularly in its longitudinal direction, and the cross sectional area of the fan blade 3 is divided into two parts 3*i* (fan inner peripheral side) and 3*o* (fan outer peripheral side) at its central portion in the blade chord length by a chain-dot central division line L.

Figure 7:
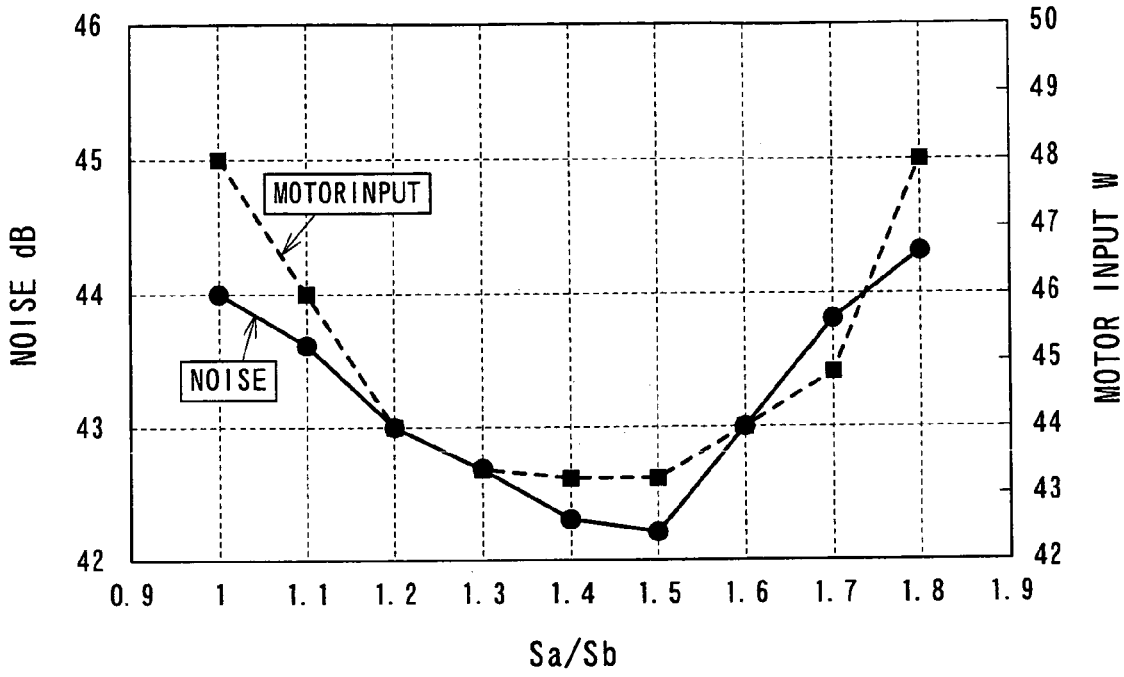
FIG. 7 is a diagram showing a test result with respect to a sectional area ratio Sa/Sb of divided fan blade portions, concerning FIG. 3, at a time when the cross flow fan of the present invention is assembled and operated in the indoor unit of the air conditioner.

According to the present invention, as shown in FIG. 3, the sectional areas Sa (fan inner peripheral side) and Sb (fan outer peripheral side) divided by the central division line L are not symmetric, i.e., have no symmetrical stream-line shapes, and the ratio of Sa/Sb is determined to be in a range of 1.3 to 1.6 Further, when the ratio Sa/Sb is out of this range of 1.3 to 1.6, air flow noise and motor input (load), i.e., input power consumption, are both extremely increased as shown in FIG. 7.

Figure 8:
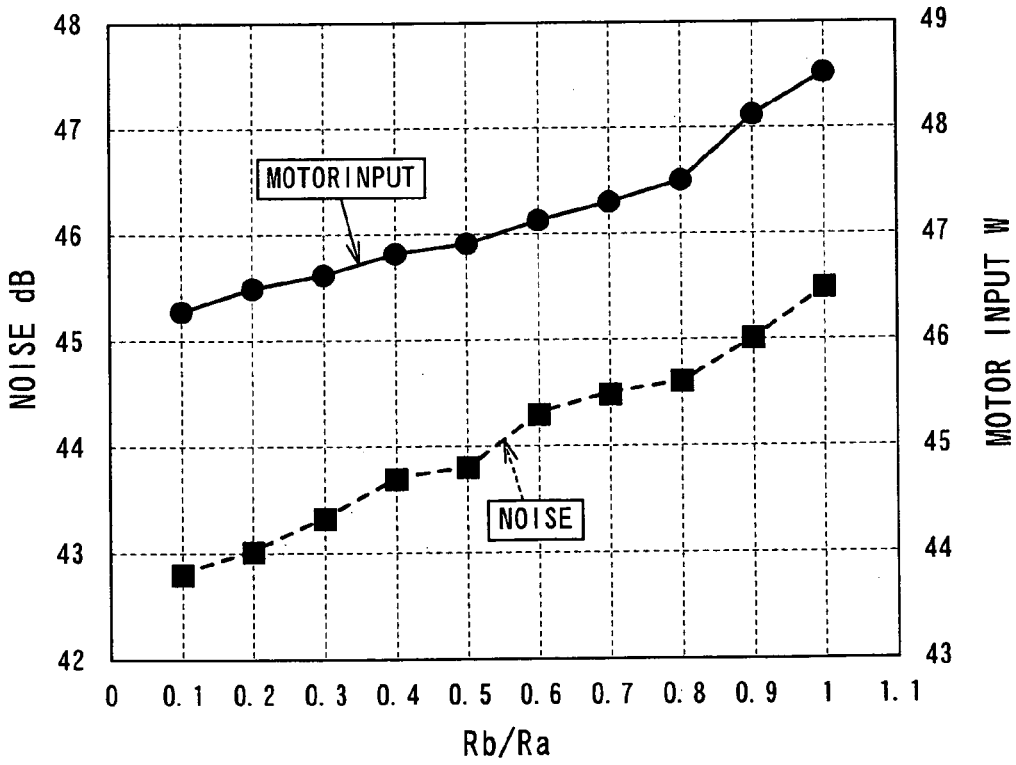
FIG. 8 is a diagram showing a test result with respect to a dimensional ratio Rb/Ra of the fan blade at blade tip end portions, concerning FIG. 4, at a time when the cross flow fan of the present invention is assembled and operated in the indoor unit of the air conditioner.

Furthermore, as shown in FIG. 4, in the present embodiment, it is desired that a ratio of Rb/Ra is 0.1 to 0.8, in which Ra is a dimension of the end R-portion of the fan inner peripheral side 3*i* of the blade 3 and Rb is a dimension of the end R-portion of the fan outer peripheral side 3*o* of the blade 3. Further, as shown in FIG. 8, in a case that the ratio Rb/Ra exceeds this range of 0.1 to 0.8, the air flow noise and the motor input are extremely increased, providing a problem in practical use.

Figure 9:
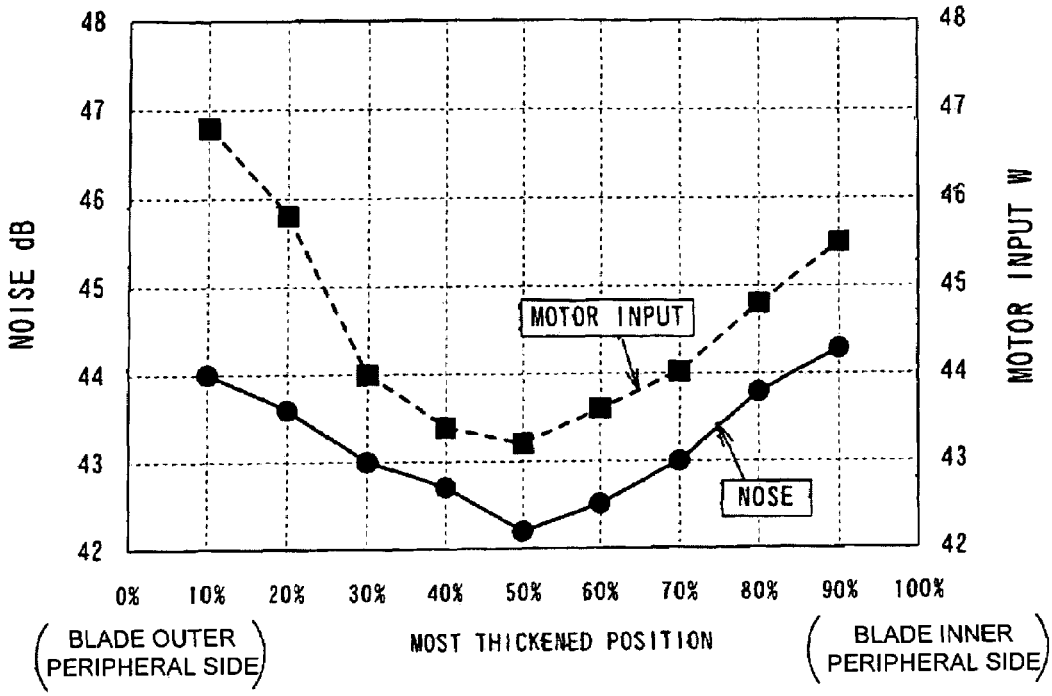
FIG. 9 is a diagram showing a test result with respect to the maximum thickness positions t of the fan blade in its chord length direction, concerning FIG. 5, at a time when the cross flow fan of the present invention is assembled and operated in the indoor unit of the air conditioner.
Figure 10:
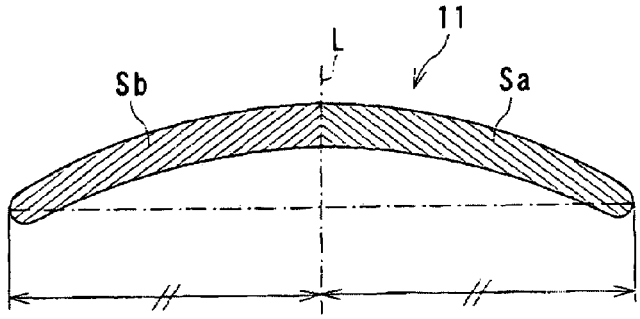
FIG. 10 PRIOR ART
FIG. 10 shows a cross sectional view of a fan blade of a cross flow fan having a conventional structure.

Moreover, as shown in FIG. 5, it is desired that the central portion in the blade chord length direction portion, has a blade thickness t which is largest in the blade chord direction (most thickened portion). As shown in FIG. 9, the air flow noise and the motor input are rapidly increased as being apart from this central portion.

According to the cross flow fan of the structures mentioned above, when the fan blade 3 is divided equally at the central portion thereof in its chord length direction, the sectional areas of both divided half portions provide the stream-line shapes asymmetric with each other. Therefore, the peel-off phenomenon to the upper surface portion of the fan blade 3 due to the air flow can be suppressed, and in addition, since the area ratio Sa/Sb of these two portions is determined to be within 1.3 to 1.6, the noise due to the flowing air and the load to the fan driving motor can be significantly reduced, thus being advantageous.

Furthermore, the dimensions of the R-portions of the tip ends of both the fan blade satisfy the relation of (Rb/Ra=0.1 to 0.8), so that the noise can be also reduced and the increase in the motor input power consumption can be also suppressed.

In addition, the fan blade according to the present embodiment has the largest thickness at its central portion in the blade chord direction, i.e., blade arcuate peripheral portion, so that the noise and the motor input can be made minimal.

Figure 6:
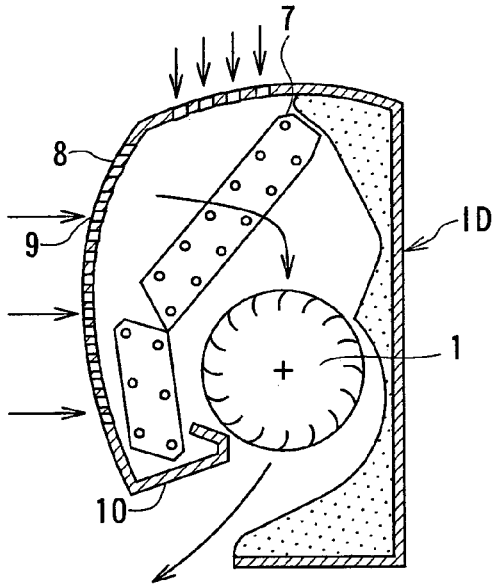
FIG. 6 is an illustration of an indoor unit of an air conditioner provided with the cross flow fan of the present invention.

In order to confirm the effective functions of the present invention, the following experiments had been performed as Test Examples by incorporating the cross flow fan having the above structures and dimensions into an indoor unit ID shown in FIG. 6.

With reference to FIG. 6, the indoor unit ID is of general type and includes a front side portion 8 to which a plurality of openings 9 are formed, through which air is introduced into the indoor unit. The air introduced in the indoor unit ID flows through a heat exchanger 7 and the cross flow fan 1 of the structure of the described embodiment. The air passing through the cross flow fan 1 is then blown out through an outlet 10.

TEST EXAMPLE 1

A cross flow fan having the structure shown in FIG. 1 was assembled in the indoor unit ID of an air conditioner as shown in FIG. 6. While changing the relation of the Sa/Sb ratio, the noise and the motor input were measured, the measured result being shown in FIG. 7.

As can be seen from the graph of FIG. 7, in the operation of the Sa/Sb ratio of 1.3 to 1.6, the noise and the motor input exhibited low values, and more specifically, in the range of 1.4 to 1.5, the most desirable result could be obtained. On the contrary, out of the range of 1.3 to 1.6, the noise and the motor input extremely increased.

TEST EXAMPLE 2

A cross flow fan having the same structure as that in the Example 1 was assembled in the indoor unit ID of the air conditioner as shown in FIG. 6. While changing the relation of the Rb/Ra ratio, the noise and the motor input were measured, the measured result being shown in FIG. 8.

As can be seen from the graph of FIG. 8, in the operation of the Rb/Ra ratio of 0.1 to 0.8, both the noise and the motor input slightly increased, which however did not give any adverse influence in practical use. In the operation of exceeding the ratio of 0.8, the increasing of the noise and the motor input was observed, thus providing a problem in practical use.

TEST EXAMPLE 3

A cross flow fan having the same structure as that in the Example 1 or 2 was assembled in the indoor unit ID of the air conditioner as shown in FIG. 6. The noise and the motor input were measured by changing the design of the fan blade, i.e., changing the position of the most thickened portion of the blade in its cross section, and the measured result is shown in FIG. 9.

As can be seen from the graph of FIG. 9, in the design of the fan blade 3 having the central portion in its chord direction at which the blade has the most thickened portion t, the noise and the motor input exhibited the most reduced values, and in the design of the most thickened portion apart from the central position of the fan blade, the noise and motor input rapidly and extremely increased.

Further, it will easily be noted that a more preferred example of the present invention will be provided by a cross flow fan having combined characteristic features of the cross flow fans represented by the embodiments of FIGS. 3 to 5, respectively.

What is claimed is:

1. A cross flow fan, comprising:

a pair of disc-shaped end plates; and a plurality of fan blades attached to the end plates in a ring-shaped arrangement, wherein each of the fan blades has a cross sectional area ratio of Sa/Sb in a range of 1.3 to 1.6, in which Sa is a sectional area of a fan inner peripheral side half portion of the blade and Sb is a sectional area of a fan outer peripheral side half portion of the blade at a time when the fan blade is cut perpendicularly with respect to a longitudinal direction of the fan blade and divided into two sectional areas along a central division line in a blade chord direction.

2. The cross flow fan according to claim 1, wherein each of the fan blades has a dimensional ratio of Rb/Ra in a range of 0.1 to 0.8, in which Ra is a dimension of a fan inner peripheral side tip end R-portion of the blade and Rb is a dimension of a fan outer peripheral tip end R-portion of the blade.

3. The cross flow fan according to claim 1, wherein each of the fan blades has a central portion in the blade chord direction at which the fan blade has a most thickened portion in section.

4. The cross flow fan according to claim 1, wherein the ratio of Sa/Sb is in a range of 1.4 to 1.5.

5. The cross flow fan according to claim 1, further comprising at least one disc shaped partition plate which is disposed between the end plates and to which the fan blades are attached in a ring shaped arrangement.

* * * * *